US006042111A

United States Patent [19]

Rivers et al.

[11] Patent Number: 6,042,111

[45] **Date of Patent: *Mar. 28, 2000**

[54] METHOD AND APPARATUS FOR DETECTING SLIP IN A SHEET TRANSPORT SYSTEM

[75] Inventors: Roy W. Rivers, Geneseo; Kevin M. Carolan, Webster, both of N.Y.; Jerry K. Whitfill, Arlington, Tex.

[73] Assignee: Xerox Corporation, Stamford, Conn.

[ * ] Notice: This patent is subject to a terminal disclaimer.

[21] Appl. No.: 08/912,760

[22] Filed: Aug. 18, 1997

[51] Int. Cl.[7] ..... B65H 1/00; B07C 17/00; G06F 7/00; G06F 17/00

[52] U.S. Cl. ..... 271/270; 364/478.01; 364/259

[58] Field of Search ..... 271/259, 258.03, 271/265.02, 220, 202, 258.04, 270; 364/478.16, 478.18, 478.01

[56] References Cited

U.S. PATENT DOCUMENTS

| | | | |
|---|---|---|---|
| 4,804,998 | 2/1989 | Miyawaki et al. | 355/14 X |
| 4,809,969 | 3/1989 | Bastow et al. | 271/258 |
| 4,960,272 | 10/1990 | Wierszewski et al. . | |
| 5,038,169 | 8/1991 | Marincic et al. . | |
| 5,116,035 | 5/1992 | Russel et al. | 271/3.1 X |
| 5,197,726 | 3/1993 | Nogami . | |
| 5,313,253 | 5/1994 | Martin et al. . | |
| 5,484,141 | 1/1996 | Yamashita et al. | 271/227 X |
| 5,528,347 | 6/1996 | Kamath et al. . | |
| 5,575,469 | 11/1996 | Coombs et al. | 271/270 |
| 5,815,766 | 9/1998 | Miller et al. | 399/21 X |

*Primary Examiner*—David H. Bollinger
*Assistant Examiner*—Kenneth W. Bower
*Attorney, Agent, or Firm*—Fay, Sharpe, Fagan, Minnich & McKee, LLP

[57] ABSTRACT

The printing apparatus according to the present invention includes a system for pre-warning of impending shutdown due to slippage of sheets within the printing apparatus sheet transport system. The system includes a plurality of sensors positioned along a sheet transport path for sensing sheets moving along the sheet transport path and a controller for determining an amount and location of slip within the sheet transport path by comparing outputs of the plurality of sensors. Once the location of the slip has been determined, automatic correction may be performed by the printing apparatus or manual correction may be performed by a service representative.

10 Claims, 2 Drawing Sheets

METHOD AND APPARATUS FOR DETECTING SLIP IN A SHEET TRANSPORT SYSTEM

BACKGROUND OF THE INVENTION

This invention pertains to the art of jam detection in an electrophotographic printing apparatus and, more particularly, to detection of timing of transport and delivery of sheets in a sheet transport system of a printing apparatus to determine whether slippage of transported sheets has occurred in the sheet transport system.

Electrophotographic printing devices generally include a photoconductive member which is charged to a uniform potential to sensitize the surface of the photoconductive member. The charged photoconductive member is exposed to a light image of an original document to be reproduced which selectively dissipates the charge on the photoconductive member in the areas of the irradiated image and thus forms an electrostatic latent image. The recorded electrostatic latent image on the photoconductive member corresponds to the image of the original document. A developer material including a toner is brought into contact with the photoconductive member and adheres to the photoconductive member in the pattern of the latent image to define a toner image. The toner image is subsequently transferred from the photoconductive member to a sheet of material such as paper, and by heating the sheet, the toner image is fused or fixed on the sheet.

In electrophotographic printing devices, as generally described above, the sheets on which the images are printed are transported to and from the photoconductive member by a sheet transport system which generally includes a system of drive and idler rollers and/or belts which define a sheet transport path. It is important that the sheets move through the sheet transport path with a particular timing which is synchronized to the timing of the imaging system and other systems of the machine. Many known electrophotographic imaging devices employ a registration system which registers the arrival and/or departure of a sheet at different sensing locations within the sheet transport system. The registration system allows jams to be detected when a sheet arrives or departs from a particular sensing location late. The registration system detects a jam when the arrival or departure of the sheet, called a sense event, occurs outside of a predetermined jam period or window. A jam window provides a defined range of acceptable times at which the sense event can occur without a jam being declared.

The occurrence of a sense event outside the jam window which causes a jam to be declared may be due to a variety of different problems within the sheet transport system. For example, slow drift or creeping slippage of the transported sheets within the sheet transport system will cause the sense event to be late. The lateness of the sense event caused by slip may not cause the sense event to occur outside the jam window, however, accumulated slip over time with successive use and wear of the sheet transporting members will cause the sense event to occur outside the jam window and a jam will be declared. With known electrophotographic printing devices, slow slip of sheets is not detected until a jam is declared and the machine is shut down.

Slip of the sheets during sheet transport may be caused by excessive contamination or wear of the rollers and/or belts in the sheet transport system, or by improper adjustment of the sheet transport system. However, the occurrence of slip is generally not detected until a jam is declared and, therefore, the problem which causes the slip is not corrected until the jam has been declared and the machine is shut down.

It would be desirable to be able to pre-warn a service representative of a relatively slow drift or slip of sheets within a sheet transport system causing lateness of sensed events prior to the shutdown of the device due to a jam detection. The service representative receiving the pre-warning could then correct the problem causing the slip (for example on a regular service call) and prevent the downtime caused by a shutdown of the machine at a later time. For example, the operation of the printing apparatus can be interrogated or monitored via a remote interactive communication (RIC) or by interrogating the printing apparatus through a non-volatile memory (NVM). Of course, still other electronic measuring and reporting arrangements are contemplated.

It would also be desirable to be able to determine the portion of the sheet transport path in which the slip is occurring so that the service representative is immediately aware of the location of the problem.

SUMMARY OF THE INVENTION

The present invention relates to a new and improved apparatus and method for pre-warning of impending shutdown due to slippage of sheets in a sheet transport system. The apparatus and method of the present invention address the problem of shutdown due to jam detection by detecting and allowing correction of a slippage of the sheets which are transported in a sheet transport system. The present invention also allows the location of the slip to be determined for either automatic correction by the machine itself or manual correction by a service representative.

In accordance with one aspect of the present invention, a method of detecting slip in a sheet transport system of a printing apparatus includes detecting a plurality of initial conditions representing times at which a sheet passes a plurality of successive sensing locations within the sheet transport system; adjusting a plurality of jam detection windows such that one of the plurality of initial conditions is located within each of the plurality of jam windows at a predetermined location; sensing a sense event at each of plurality of successive sensing locations; detecting slip of the sheet at the plurality of successive sensing locations within the sheet transport system; and correcting for the detected slip.

In accordance with a further aspect of the present invention, a printing apparatus or machine includes a sheet transport system for advancing individual sheets along a sheet transport path by frictional contact with a plurality of drive members. A plurality of sensors are located along the sheet transport path for sensing sheets moving along the sheet transport path. A controller determines the amount and location of slip occurring along the sheet transport path by comparing outputs of the plurality of sensors.

In accordance with a further aspect of the invention, an automatic slip correction mechanism compensates for slip of the sheets within the sheet transport path.

A principal advantage of the invention includes the ability to sense slow drift and creeping slippage of sheets which are transported in a sheet transport device prior to shutdown of the printing device. Another advantage of the invention resides in the ability to determine a location of the drift or slip.

Yet another advantage of the invention is found in the ability to correct sheet slippage prior to shutdown of the printing apparatus.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein.

DETAILED DESCRIPTION OF THE PREFERRED EMBODIMENTS

While the present invention will be described in connection with preferred embodiments thereof, it will be understood that it is not intended that the invention be limited to these embodiments.

Figure 1:
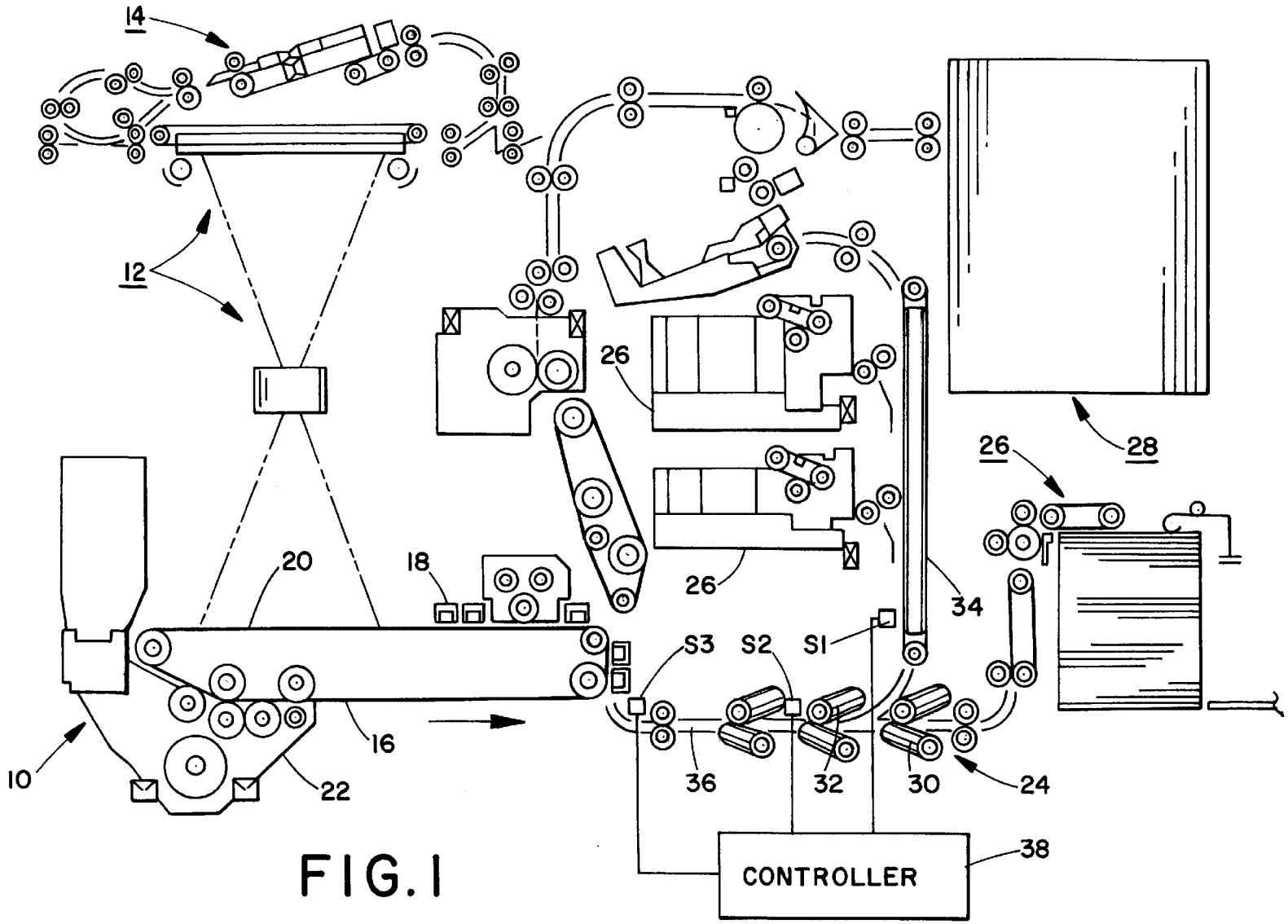
FIG. 1 is a schematic elevational view of an electrophotographic printing apparatus including a sheet transport system according to the present invention.

An electrophotographic printing apparatus incorporating the features of the present invention is illustrated in FIG. 1. The electrophotographic printing apparatus 10 generally includes an imaging system 12 having a document handling unit 14, a photoconductive member 16, a corona charger 18, an exposure station 20, and a developing station 22. A sheet transport system 24 is provided for transporting sheets on which images are to be printed from one or more sheet storage trays 26 to the photoconductive member 16 and to a sheet receiving tray 28.

The sheet transport system 24 generally transports individual cut sheets by a series of drive rollers 30, idler rollers 32, and/or belts 34. The sheet transport system 24 defines a sheet transport path 36 along which the sheets are transported according to a timed schedule which is coordinated by a controller 38 with the other systems of the electrophotographic printing apparatus. Due to contamination, wear, and/or degradation of the elastomers of the rollers and/or belts in the sheet transport system, slow drift or creeping slippage may occur causing delayed arrival of the sheets at particular sensing locations. The sensing locations include sensors S1–S3 which are positioned at preselected locations along the sheet transport path 36 so that the positions of the sheets may be determined along the sheet transport path. The particular number and locations of the sensors S1–S3 may be varied depending on the particulars of the sheet transport path 36.

Figure 2:
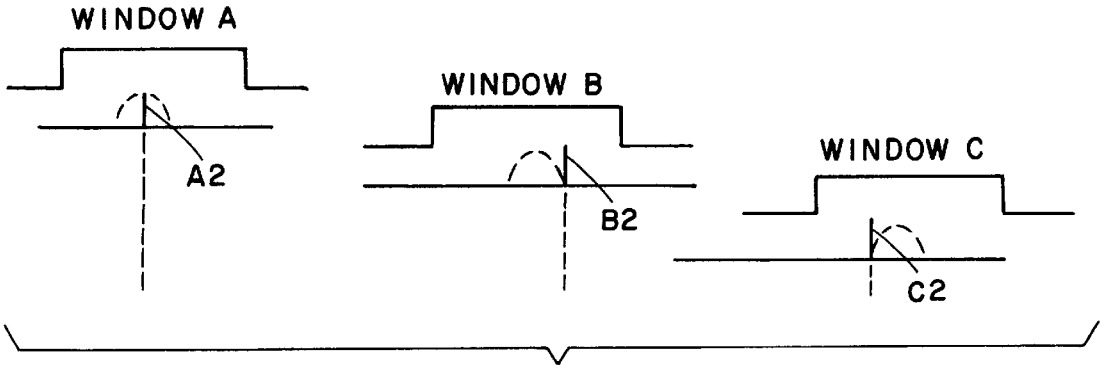
FIG. 2 is a schematic illustration of three jam detection windows and three sense events occurring within the jam detection windows.

The jam windows A, B, C of FIG. 2 correspond to different sensing locations along the sheet transport path such as the sensors S1–S3 illustrated in FIG. 1. The known systems detect a sense event A2, B2, C2 which indicates the timing or position of a sheet. The sense event generally corresponds to the timing or positioning of the leading or trailing edge of a sheet at one of the different sensors S1–S3 along the sheet transport path.

As long as a sense event occurs within each of the jam windows A, B, C, the printing apparatus continues to operate. However, if an error, such as slipping of the sheets, occurs which causes the sense event A2, B2, C2 to occur outside of one of the jam windows, a jam is declared and the printing apparatus is shut down. Thus, it will be understood that jam windows A, B, C are representative of any three sensors S1–S3 and that more or less sensors and jam windows can be used to accurately monitor slip in operation of the printing apparatus. Moreover, jam windows A, B, C represent serial windows as will be understood from the following description where slip in an upstream jam window (e.g., jam window B) is also detected in the downstream jam window (e.g., jam window C), which also detects further slippage that may have occurred between these windows. Thus, tolerance stack-up in slippage being detected and compounded at downstream jam windows results in eventual machine shutdown if the compounded slip detection extends outside the jam window.

Figure 3:
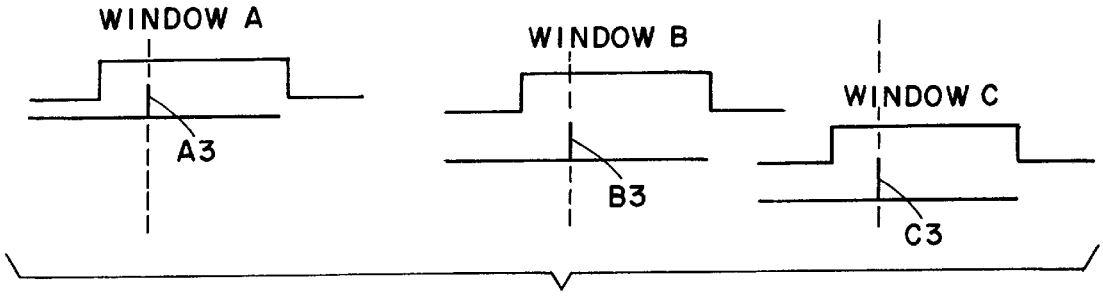
FIG. 3 is a schematic illustration of three jam detection windows which have been adjusted depending on the three initial sense events.

According to the present invention, the locations of the jam windows A, B, C are adjusted to allow for a certain amount of slip to occur at each of the sensors S1–S3. Due to machine variations in the sheet transport path, such as minor variations in roller diameter, the locations of the sheets at particular times may vary for different machines. In order to optimize the performance of the machine and account for manufacturing variations, the jam windows are adjusted or calibrated prior to the first use of the machine. As illustrated in FIG. 3, the jam windows A, B, C are adjusted so that the sense event A3, B3, C3 in an initial condition is closer to a leading edge (left side) of the respective jam window than to a trailing edge (right side). Since the sheets which are transported by the sheet transport device cannot move faster than a feeding speed and can, and often will, move slower due to slippage of the sheets, the adjustment of the jam windows A, B, C toward a position more closely adjacent to the leading edge than the trailing edge allows for slippage at each of the sensors S1–S3 and prevents unnecessary shutdowns.

The adjustment of the jam windows A, B, C according to the present invention as shown in FIG. 3 is preferably conducted electronically at the manufacturer. This adjustment can be part of routine testing of the printing device as part of the manufacturer's quality control program before shipment to a customer. Once the printing apparatus is at the customer site, the adjustment of the jam windows can be repeated if necessary. As seen by comparing FIGS. 2 and 3, which represent before and after adjustment of the jam windows A, B, C, the adjustment prevents unnecessary shutdowns which may occur when the initial condition is close to the edge of a window jam. For example, as illustrated in FIG. 2, the sense event B2 is closer to the right edge of the jam window B. Thus, a small amount of slip of the transported sheets at the location corresponding to the jam window B of the sheet transport device will cause shutdown. In contrast, once the jam window B has been adjusted to the right as shown in FIG. 3, the sense event B3 is closer to the leading edge of the window and such a premature shutdown will be prevented.

Figure 4:
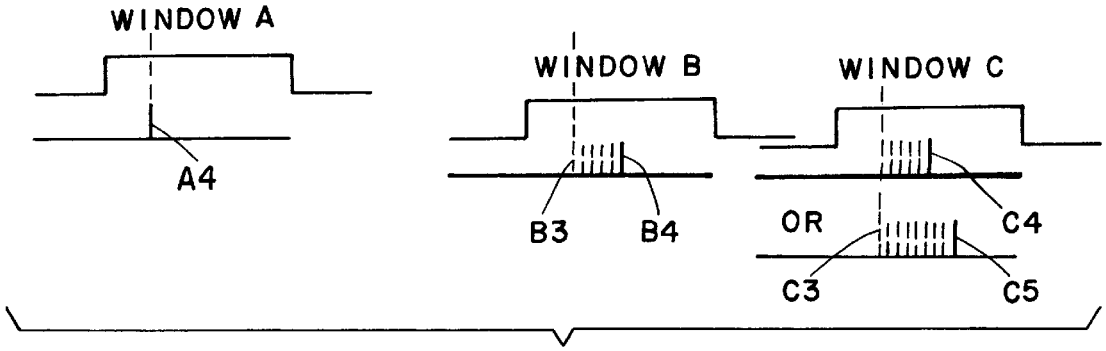
FIG. 4 is a schematic illustration of three jam detection windows and sense events which indicate the occurrence of a slip.

FIG. 4 illustrates the occurrence of slip during transport of the sheets. As illustrated, the sense event A4 which occurs within the jam window A has not slipped from the initial condition A3 illustrated in FIG. 3. However, the sense event B4 which occurs within the window B has slipped from the initial position B3 of the sense event. The amount of slip which has occurred between the location of window A and the next sensing location of window B is measured as the distance between B3 and B4 and reported by the controller. By identification of the amount of slip and the location of the slip, the service representative can identify and correct the cause of the slip.

FIG. 4 illustrates a sense event C4 and a sense event C5 either of which may occur at the location of the jam window C. The location of the sense event C4 indicates that no further slip has occurred between the locations of jam windows B and C because the distance between C3 and C4 is the same as the distance between B3 and B4. In contrast, the location of the sense event C5 indicates that an additional amount of slip has occurred between the locations of jam windows B and C.

The amount and location of slip which are determined as described above are monitored and reported by the controller 38. The information provided by the controller 38 is used to pre-warn the service representative that service is needed before the amount of slip results in an out of jam window condition, thus prompting shutdown of the printing apparatus when minor adjustments would otherwise allow the apparatus to continue operating. The information provided by the controller 38 may be reported electronically to a remote location in a known manner, such as via a remote interactive communication (RIC). The information may also be stored in non-volatile memory (NVM) and retrieved by the service representative or organization such as on a service call. The service representative can correct the problem which has caused the slip, for example, by replacing worn rollers or by cleaning contaminated parts.

The information provided by the controller 38 which identifies the amount and location of slip may also be used to automatically provide either a temporary or permanent correction for slip. Automatic correction of slip may be performed by adjustment of the movement command delivered to the sheet transport system 24. For example, the speed of one or more of the rollers or belts may be increased in certain areas of the sheet transport system to increase the feeding speed and advance the sheet back to a desired timing sequence. Alternatively, the sheets may be fed out earlier from one of the sheet storage trays 26 to compensate for slip detected later (or downstream) in the sheet transport path 24. Another method of automatic correction involves the use of a servo system 40 to accelerate the sheet at a particular location within the sheet transport path where slip has occurred to re-synchronize the sheets to the desired positions.

In order to adjust for slip which occurs between two sensing locations along the sheet transport path 24, an adjustment of subsequent jam windows may be performed. The adjustment of subsequent jam windows downstream of the location at which the slip is occurring will prevent the determination of a jam due to the accumulation, or stack-up, of slip at locations of subsequent jam windows. For example, if a large slip occurs between jam windows A and B, jam window C and all subsequent jam windows may be shifted to the right by an amount of the slip between jam windows A and B. This will prevent shutdown of the machine until a service representative can correct the cause of the slip between jam windows A and B.

In some cases, the slip information provided by the present invention enables the machine to correct itself completely or to a sufficient level to keep the machine functioning at a lower thruput rather than shutting down the machine. One method of automatic correction involves skipping pitches by maintaining the same process speed and changing to a fewer number of equally spaced images. For example, the machine can change from five equally spaced images to four equally spaced images when a stapler is no longer able to keep up with the maximum thruput.

The automatic corrections described above are generally temporary fixes which will allows the machine to continue to operate until a service representative can service the machine. When the machine has been serviced by cleaning or replacing the worn or contaminating parts of the sheet transport system the jam windows are preferably automatically adjusted according to the process described with respect to FIG. 2.

The detection of the sense events in the present invention are performed in a known manner, i.e., the use of sensors S1–S3 in connection with machine clock information to determine a time at which a leading or a trailing edge of a sheet passes a particular sensing location.

The present invention is most useful in a machine having a long sheet transport path where cumulative errors, though individually slight, become a major consideration to downstream jam detection.

The advantages of the system according to the present invention include the ability to identify the slip source or slip zone where slip is occurring within the sheet transport path. Known jam detection systems often declare a jam somewhere downstream in the sheet transport path due to cumulative slip. For example, in known systems where a large slip occurs early in the sheet transport path, yet the slip is not large enough to trigger a jam determination, the jam determination may be triggered after several smaller slips have occurred downstream. The present invention provides a method to determine where the slip is actually occurring, i.e., between S1 and S2 or between S2 and S3, and offers the opportunity for automatic correction or for the service representative to perform a more in-depth examination of a defined abnormal magnitude slip zone. It should be understood that any number of sensors may be used with increased numbers of sensors permitting more accurate determination of the location of the slip.

The slip data provided by the present invention will also be useful in identifying best minimum slip designs of sheet transport systems.

The invention has been described with reference to preferred embodiments. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A paper jam shutdown pre-warning method of determining paper sheet slip in a sheet transport system for transporting paper sheets on which an output image is to be printed in a printing apparatus, the method comprising:

prior to an initial use of the printing apparatus by an end-user, conveying an initial paper sheet through said sheet transport system;

detecting a plurality of initial conditions representing times at which said initial paper sheet passes a plurality of successive sensing locations within the sheet transport system;

establishing a plurality of jam detection windows that are respectively defined by a time period in which a subsequent paper sheet is to pass said plurality of successive sensing locations, said jam detection windows defined to coincide respectively with the plurality of initial conditions such that each of said jam detection windows is non-symmetrically defined about said initial condition respectively coincident therewith;

conveying a subsequent paper sheet through said sheet transport system for purposes of printing information on said subsequent paper sheet;

sensing a sense event at each of the plurality of successive sensing locations, said sense event defined by passage of an edge of said subsequent paper sheet past said sensing location;

at each of said successive sensing locations, deriving slip of the subsequent paper sheet in the sheet transport system by comparing the position of the sense event with the initial condition in said respective jam detection window and with any slip derived in association with an upstream jam detection window;

recording information that describes said derived slip in a memory; and, accessing said recorded information that describes said derived slip to pre-warn of an imminent paper jam prior to an occurrence of said imminent paper jam.

2. The method of claim 1, further comprising:

electronically adjusting the plurality of jam detection windows relative to said plurality of sense events respectively associated therewith when minor, cumulative slippage of a sheet is determined to be occurring over time so as to prevent subsequent sense events from failing to coincide with a respective one of said plurality of jam detection windows due to said cumulative sheet slippage.

3. The method of claim 1, wherein said step of recording information that describes said derived slip comprises sending a signal indicative of sheet slippage to a remotely located service representative over a network connection.

4. The method of claim 1, further comprising:

determining a location of the slip within the sheet transport system by comparing slip derived in association with a downstream one of said jam detection windows with slip derived in association with an upstream one of said jam detection windows to determine if the slip derived in association with the downstream one of said jam detection windows is a result of slip previously derived in association with the upstream jam detection window.

5. The method of claim 1, further comprising:

automatically adjusting the sheet transport system to correct the slip by altering the speed of at least one sheet conveying element in said sheet transport system.

6. The method of claim 5, wherein the automatic correction is performed by a servo system.

7. A printing machine comprising:

an electronic controller;

a sheet transport system for advancing individual sheets along a sheet transport path by frictional contact with a plurality of drive members so that said sheets are positioned to receive printed information thereon;

a plurality of sensors operatively connected to said controller and located along the sheet transport path each for sensing a sense event when a sheet moves along the sheet transport path past said sensor;

means for establishing a jam detection window associated with each of said plurality of sensors, said jam detection window associated with each sensor defined by a time period in which said sensor must sense a sense event to prevent said controller from determining that a sheet jam condition has occurred on said sheet transport path;

means for establishing an initial location in each of said jam detection windows based upon passage of an initial sheet through said sheet transport system, said initial location defining a time respectively within said window when a sense event is sensed when no slippage of a sheet occurs, wherein said means for establishing said jam detection window defines each of said windows to be non-symmetric relative to said respective initial location in said jam detection window;

means for comparing a location of a sense event in each of said jam detection windows with the initial location associated with each of said jam detection windows and for determining that sheet slippage has occurred when a sense event in at least one of said jam detection windows does not coincide with an initial location in said at least one of said jam detection windows; and, means for non-volatile storage of a record of said determined slippage.

8. The printing machine of claim 7, further comprising an automatic correction mechanism for compensating for slip of sheets within the sheet transport path by changing a speed at which sheets are conveyed along said sheet transport path.

9. The printing machine of claim 7 further comprising:

means for electronically adjusting the jam detection windows of the sheet transport system in an amount based upon determined slip to compensate for the determined slip occurring within the sheet transport path and to prevent a subsequent sense event from falling outside one of said jam detection windows.

10. The printing machine of claim 9, wherein said means for electronically adjusting jam detection windows adjusts only jam detection windows that are associated with sensors downstream relative to the sensor in association with which sheet slippage has been determined to compensate for the determined slip and to prevent shutdown of the printing machine.

* * * * *